US006212834B1

(12) United States Patent
Lindgren

(10) Patent No.: US 6,212,834 B1
(45) Date of Patent: Apr. 10, 2001

(54) FLASHING ARRANGEMENT FOR WINDOWS, IN PARTICULAR ROOF WINDOWS

(75) Inventor: Claes Lindgren, Farum (DK)

(73) Assignee: V. Kann Rasmussen Industri A/S, Soborg (DK)

( * ) Notice: Subject to any disclaimer, the term of this patent is extended or adjusted under 35 U.S.C. 154(b) by 514 days.

(21) Appl. No.: 08/861,746

(22) Filed: May 22, 1997

Related U.S. Application Data

(63) Continuation of application No. 08/335,758, filed on Nov. 14, 1994, now abandoned.

(30) Foreign Application Priority Data

Jun. 23, 1992 (DK) ..... 0827/92

(51) Int. Cl.[7] ..... E04B 7/18; E04D 13/14
(52) U.S. Cl. ..... 52/200; 52/60
(58) Field of Search ..... 52/200, 58, 60, 52/219, 72, 302.1, 302.6

(56) References Cited

U.S. PATENT DOCUMENTS 4,527,368 * 7/1985 Jentoft ..... 52/200
5,207,036 * 5/1993 Sampson et al. ..... 52/200

FOREIGN PATENT DOCUMENTS

2449176 * 10/1980 (FR) ..... 52/60
1587199 * 4/1981 (GB) ..... 52/200
31879 6/1943 (PL) .

* cited by examiner

*Primary Examiner*—Michael Safavi
(74) *Attorney, Agent, or Firm*—Venable; John P. Shannon

(57) ABSTRACT

A flashing arrangement for windows including flashing elements attached to the window frame members for providing a waterproof flashing frame around the window frame. The flashing elements at the top member and side members of the window frame are made of profiles of an elastically deformable material and have a U-shaped cross section, where the first side flange is attached to the outside of the corresponding window frame member, while the other side flange provides sealing abutment with the underside of the surrounding roof. The flashing element at the bottom window frame member comprises an L-shaped profile with an upright flange for connection to the bottom member of the window frame and an outwardly protruding flange which can be connected to a flexible and strip-shaped flashing element of a plastically deformable material. The flashing frame can be manufactured by welding together extruded profile elements made of rubber or a thermoplastic elastomer or can be made in one piece by injection molding.

30 Claims, 5 Drawing Sheets

FLASHING ARRANGEMENT FOR WINDOWS, IN PARTICULAR ROOF WINDOWS

Figure 1:
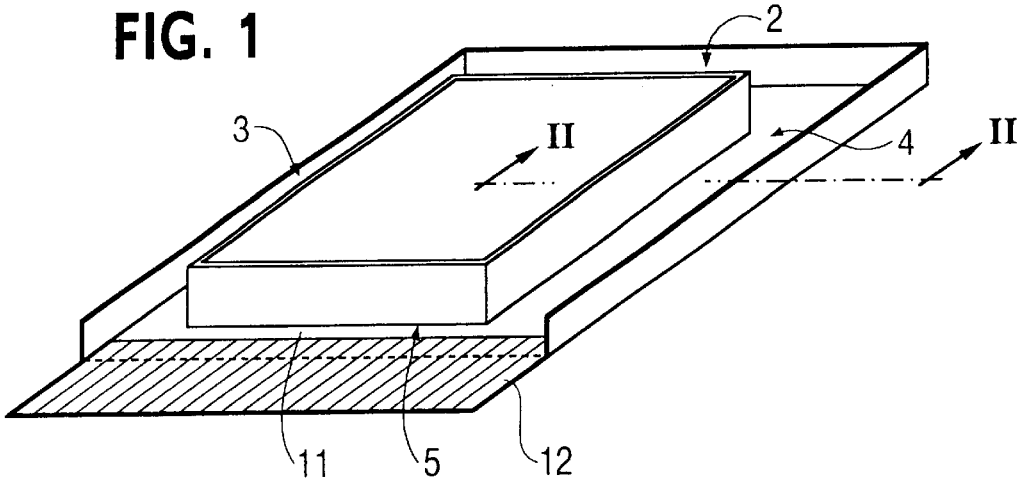

This application is a continuation of Ser. No. 08/335,758, filed on Nov. 14, 1994 now abandoned.

The invention relates to a flashing arrangement for windows, in particular roof windows, with a mainly rectangular window frame comprising a top member, two side members, and a bottom member, comprising flashing elements attached to the frame members, said flashing elements being profiles of a flexible material for providing a waterproof flashing frame around the window frame, the flashing elements at the top and side members of the window having a U-shaped cross section comprising a bottom plane, which in its working position is substantially parallel to the glass section of the window, and two upwardly protruding side flanges, of which a first side flange is attached to the outside of the corresponding member of the window frame.

When installing windows in inclined roofs the establishment of weatherproof and waterproof joints between the main frame structure and the surrounding roofing material has traditionally been performed on site in connection with the installation and by means of for instance lead, zinc, copper, aluminum or other types of deformable materials.

From DK-B-148922 a flashing arrangement of the above-mentioned kind is know incorporating a flashing collar providing a water discharge duct and connectable with an extension profile of metal, plastics or another rigid or slightly flexible material. In this prior art design, a special member is required to provide sealing towards the underside of the surrounding roofing and the arrangement is not adapted for easy connection with a standard flashing element such as a conventional lead skirt below the bottom member of the frame.

From U.S. Pat. No. 4,589,238 a window structure with a frame constructed from hollow plastic profiles is known, where the profile elements by co-extrusion are produced in one piece with an encircling flexible sealing flange of PVC, which is placed under the surrounding roofing.

With this design a window can be delivered substantially ready for installation, such that an easier installation is achieved, which is particularly advantageous when several closely spaced windows are to be installed either side by side or above each other.

However, the latter design is limited in that it can only be used together with plastic frame structures and mainly plane types of roofing, such as slating and the like, since the sealing flange has not been designed to be deformable to such a degree that it may be placed in sealing abutment with a wave-shaped roofing, such as for instance roofing tiles.

Starting from this known technique it is the object of the invention to provide a flashing arrangement suitable for factory assembly, such that the installation work is made easier and less expensive, while it may be utilized together with all common types of roofing and easily connected with the surrounding roofing as well as other conventional flashing elements without the use of separate sealing members.

To achieve this object the sealing arrangement according to the invention is characterized in that the flashing elements at the top and side members of the window frame are made of an elastically deformable material and that the other of said two side flanges serves as a seal in sealing abutment with the underside of the surrounding roofing, while the flashing element at the bottom member includes a profile with a mainly L-shaped cross section with an upright flange for connection to the outside of the main frame bottom member and an outwardly protruding flange.

With this arrangement a U-shaped channel is established along the top and side members of the main frame structure, said channel at the top member providing a valley from which water may be led around the frame structure and through the channels acting as drains along the side members, in order to finally be drained off across the sealing element connected to the bottom member.

The elastic deformability of the flashing arrangements together with the U-shaped cross-sectional profile results in a particularly good fit to the surrounding roofing, in that the other side flange, which is separated from main frame structure, can be deformed for a sealing abutment with the underside of any common roofing, for instance by bending the side flange more or less outwards from the U-profile, possibly to such a degree that it is nearly flush with the bottom plane of the profile.

As a further consequence of the elastic deformability the factory mounted flashing elements can easily be wrapped up over the main frame structure during packing and shipping, resulting in only a minimal increase of its outer dimensions.

In the case of flat and plane roofings, such as for instance slating or cardboard, the L-shaped flashing element at the bottom member can be joined directly to the roofing by placing the protruding flange of the profile either under or in sealing abutment with the top side of the material underlying the roofing. As another possibility, particularly well suited for wave-shaped roofings as for instance tiles, the protruding flange of the L-shaped flashing element may be designed to be connected, for instance by gluing, to another flexible and plastically deformable flashing element, which may be of the above mentioned traditional type or of the unleaded design described in International Patent Application No. WO 93/06318, and having improved deformability which will further contribute to facilitating the installation work.

As a particular advantage, the invention makes it also possible, in a simple manner to establish sealing flashings between relatively closely spaced neighboring windows, for instance when the spacing is about 100 mm, corresponding to the normal width of a rafter, regardless of whether the windows are placed next to or above each other.

For windows placed side by side a particularly well suited embodiment according to the invention is characterized in that a coupling flange is constructed on the top side of the bottom face of the U-profile at a relatively short distance from said first side flange, where said coupling flange extends towards said first side flange substantially in parallel to the bottom face, and during the installation of two windows side by side may be placed in abutment with the corresponding coupling flange of the neighboring window after having cut off the part of the flashing elements lying between said coupling flange and the other side flange along the mutually opposing side members of the window frame, after which the two coupling flanges are connected by a profiled sliding rail with bent flange sections fitting into the space between the two coupling flanges and the bottom faces of the respective flashing elements.

Since the flashing element at the top member of the main frame on account of providing a valley preferably is designed with an increased width compared to the the flashing requirements at the side members, a similar building together of windows placed above each other may be obtained when the flashing element at the top member of the window frame in the middle section between said first and second side flange has an additional upwardly protruding flange, which during the installation of two windows above each other may be placed under the L-shaped flashing element at the bottom frame member of the above window after having cut off the part of the flashing element lying between said additional flange and the second side flange.

Figure 2:
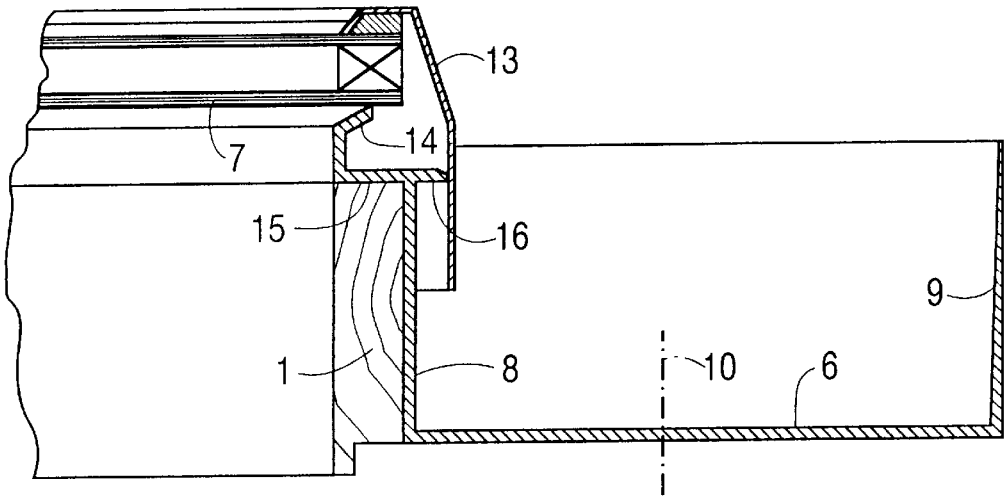
Figure 3:
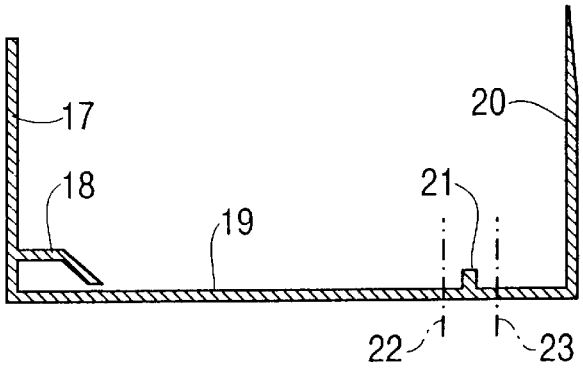
Figure 4:
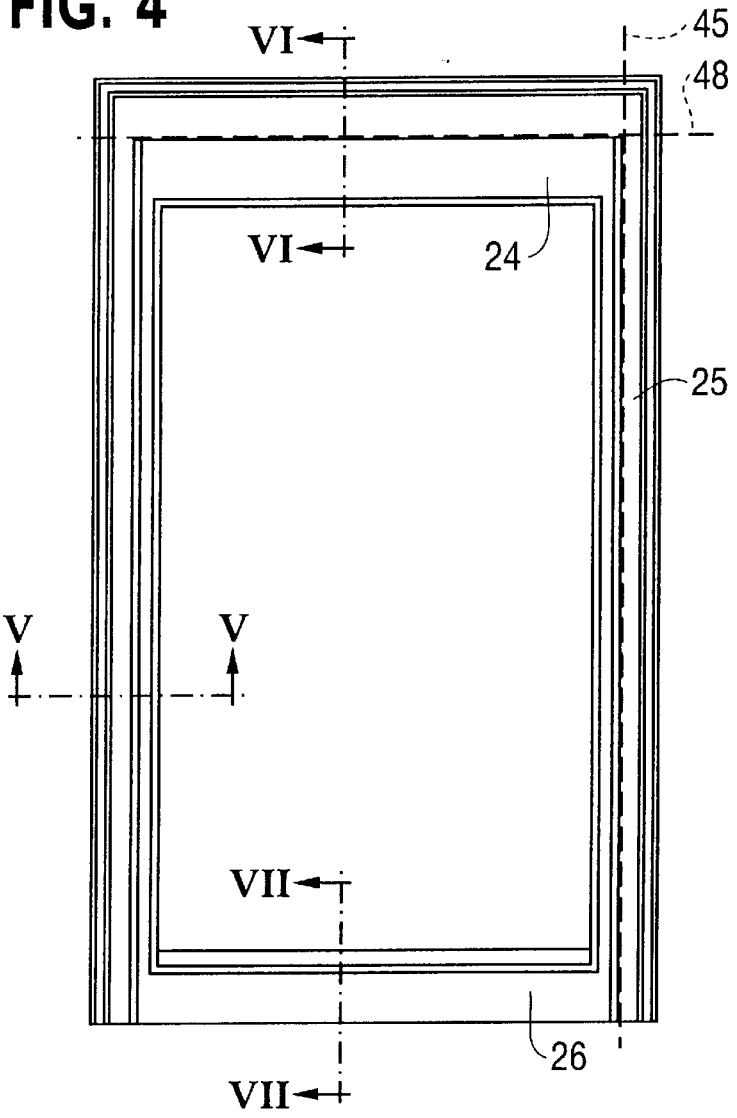
Figure 10:
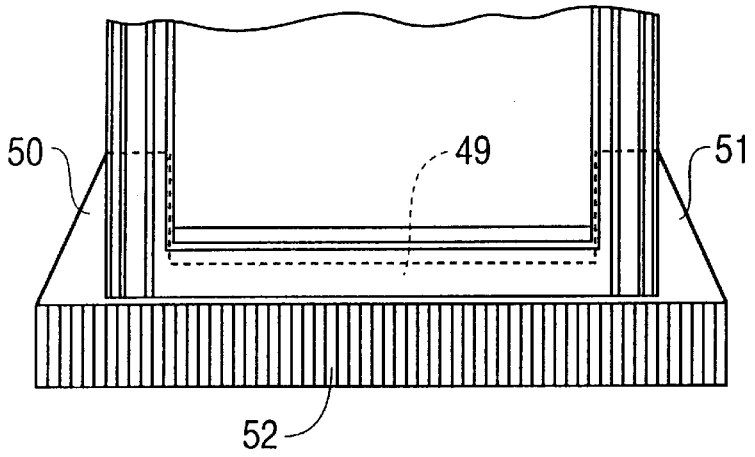
Figure 5:
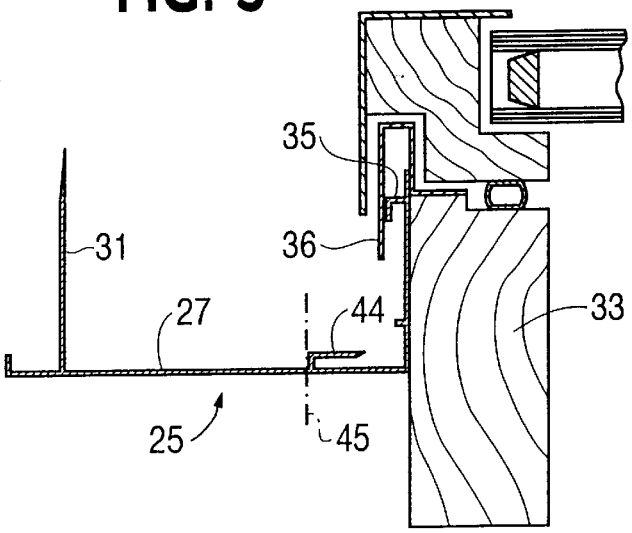
Figure 6:
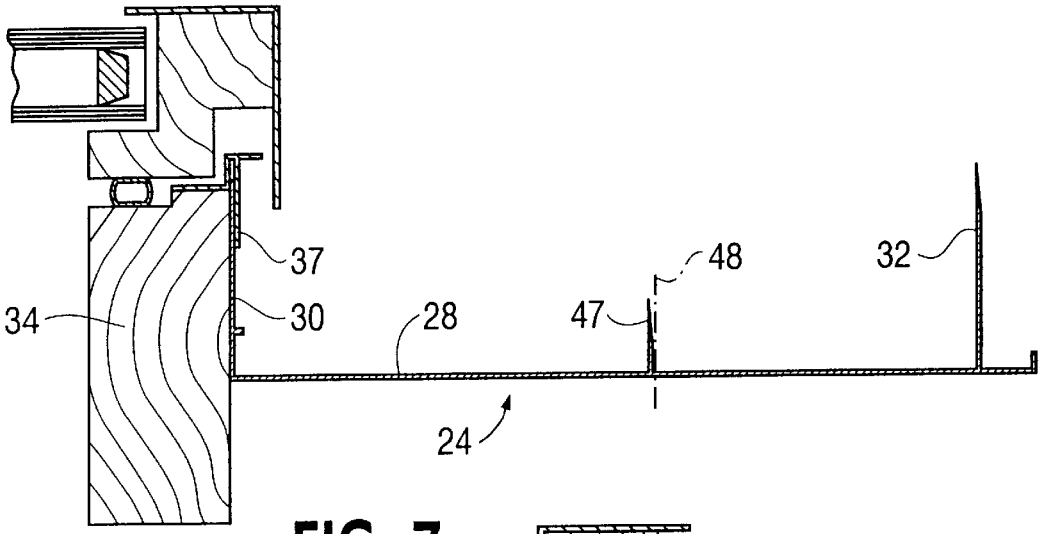
Figure 7:
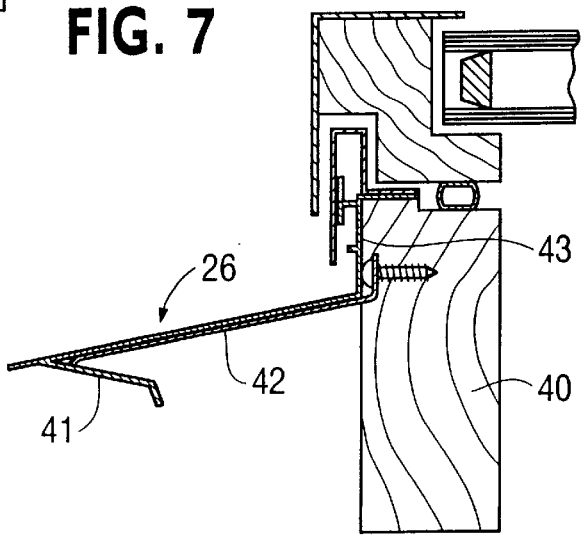
Figure 8:
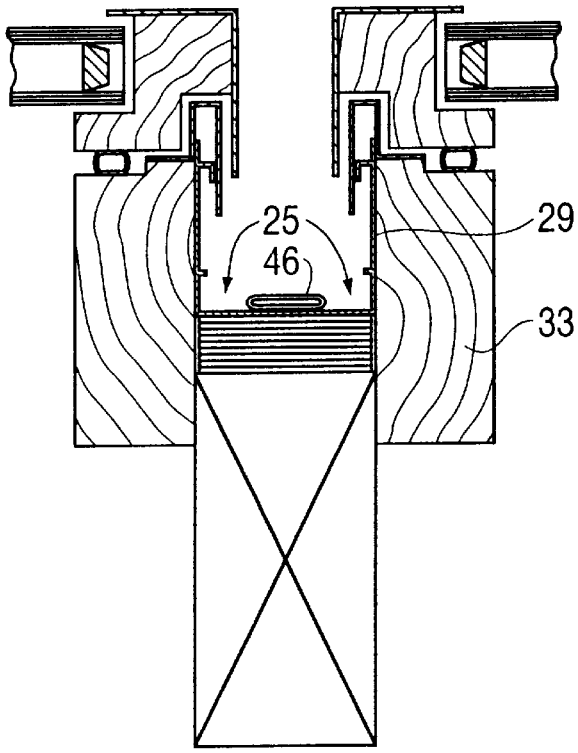
Figure 9:
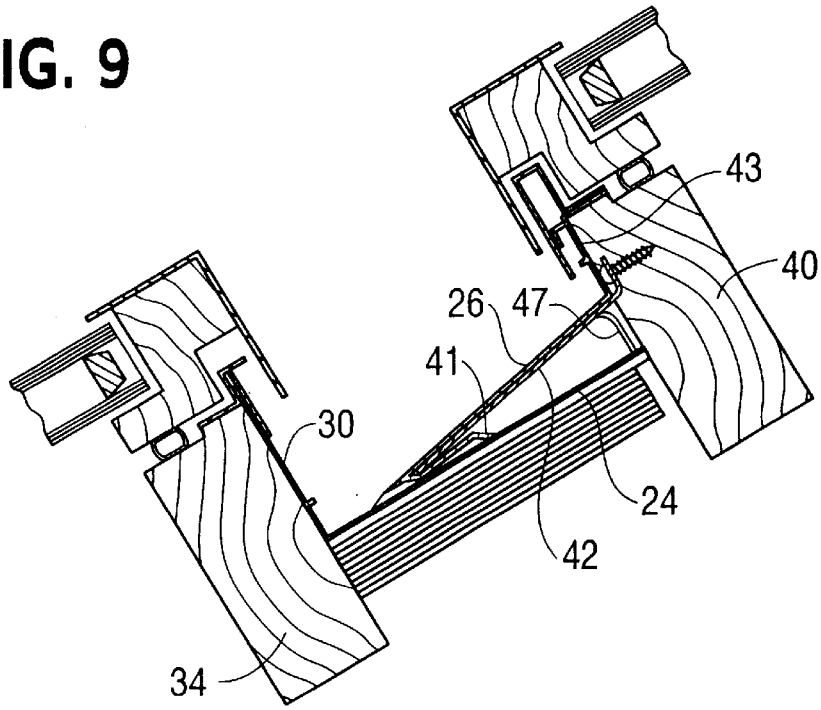
Figure 11:
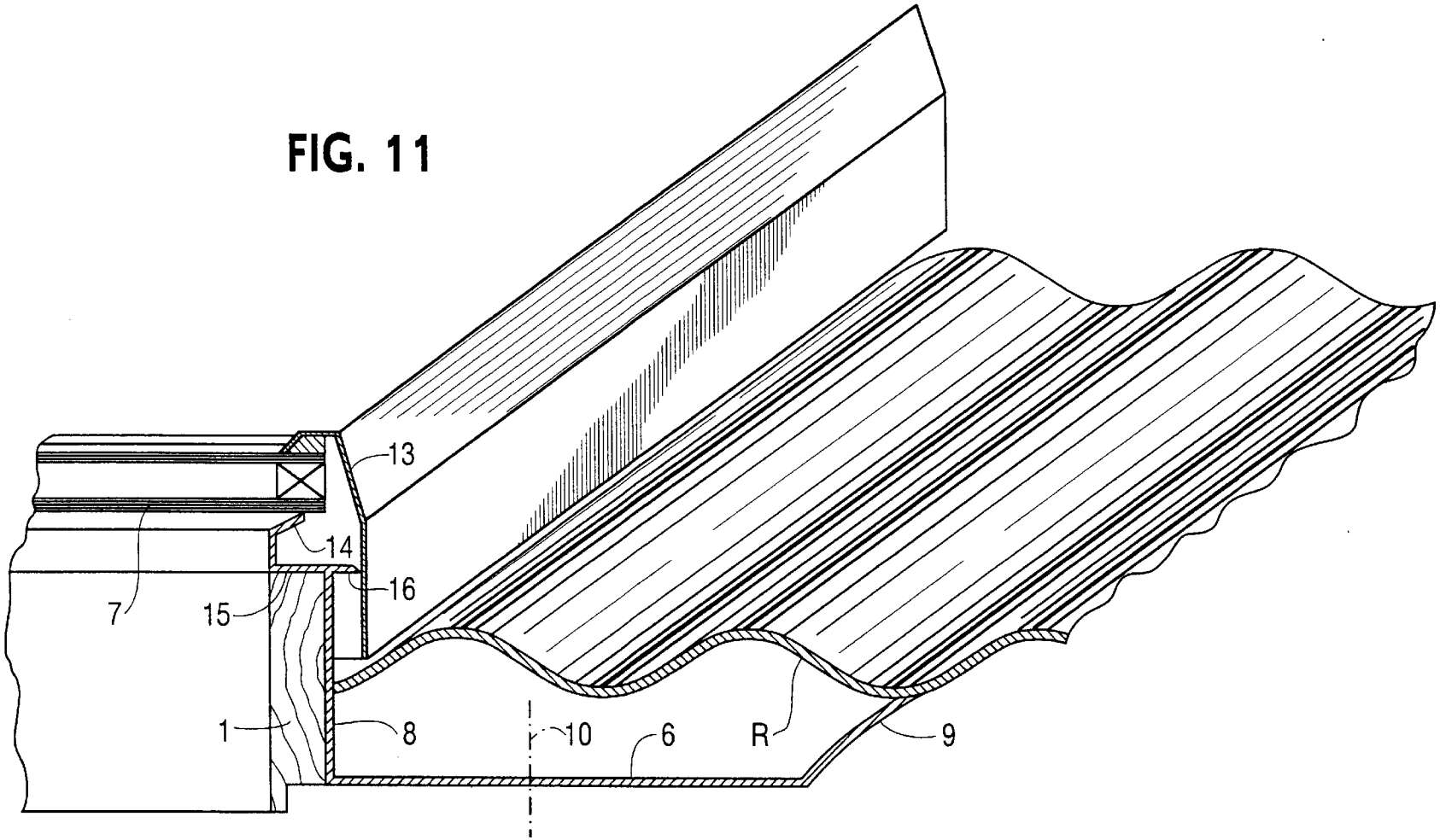

In the following the invention is explained in more detail with reference to the schematic drawing, where FIG. 1 shows a first embodiment of a flashing arrangement for windows according to the invention in perspective;

FIG. 2 a sectional view along the axis II—II in FIG. 1;

FIG. 3 a cross section of an alternative embodiment for flashing elements for mounting on the side members of a window frame;

FIG. 4 a plane view of a preferred embodiment of the flashing arrangement;

FIGS. 5–7 a sectional view along the axes V—V, VI—VI, and VII—VII in FIG. 4;

FIGS. 8–9 illustrate the construction of the flashing arrangement in FIGS. 4–7 by the building together of windows either side by side or above each other, respectively;

FIG. 10 an alternative embodiment for a flashing element for mounting on a side member of a window frame; and FIG. 11 is a perspective view showing the flashing element in combination with the surrounding roofing.

The flashing frame according to the invention illustrated in FIG. 1 is designed for mounting on the main frame structure of a skylight to be built into a roof with an inclined plane. In this main frame structure, which may be of a conventional design including a top member, two side members, and a bottom member, the sectional view in FIG. 2 only shows one of the side members 1.

According to the invention the flashing frame, which is designed with factory assembly in mind, comprises a flashing element 2 for attachment to the main frame top member, elements 3 and 4 for attachment to the main frame side members, and an element 5 for attachment to the main frame bottom member.

The flashing elements 2, 3, and 4 have, as shown in FIG. 2, a mainly U-shaped cross-sectional profile comprising a bottom face 6, which, when the frame is mounted on the window, essentially extends in parallel to the glass section 7 of the window, and two side flanges 8 and 9 protruding upwards from the bottom face 6. However, the flashing element 2 for mounting onto the top member of the frame preferably has a greater width than the elements 3 and 4 intended for mounting on the side members on account of its function as a valley, which will be described in the following.

The first side flange 8 is designed for attachment to the outside of the window frame member 1, while the other side flange 9 being remote from the frame structure provides abutment with the underside of the surrounding not shown roofing.

In contrast to the elements 2,3, and 4, the flashing element 5 comprises an L-shaped profile corresponding to the part of the cross-section shown in FIG. 2 lying to the left of the dashed line 10, i.e. with an upwardly protruding flange corresponding to the first side flange 8 intended for attachment to the main frame bottom member, and an outwardly protruding flange 11, which in the shown embodiment is designed for connection to another plastically deformable and mainly strip-shaped adjoining element 12. In connection with flat and plane roofings, as for instance slating or cardboard, such an additional element will normally not be necessary, since the outwardly protruding flange can be placed over the upper edge of the underlying roofing.

The flashing elements 2–5 are according to the invention made of an elastically deformable material, preferably a material suitable for extrusion, as for instance rubber or a thermoplastic elastomer.

The shown rectangular frame shape of the flashing may be produced by welding together appropriate lengths of extruded profile elements with the U-shaped and L-shaped cross sections described above, whereby corner sections at the inside of the side flanges designed for attachment to the main frame side members are cut away, such that the welded frame shown in FIG. 1 provides an open channel around the window frame structure.

This manufacturing method is advantageous since flashing frames of arbitrary sizes can be produced from a limited number of profile elements for mounting on the top member, side members and bottom member of a main frame structure, respectively.

However, as another possibility the flashing frame with the exception of the joining element 12 can be produced as an assembled unit, for instance by injection moulding.

With the shown shape of the profile the flashing frame can be mounted on window frame structures of arbitrary materials, including wood, plastic and metal frame profiles. Attachment to the window frame structure can also be performed in a known manner, as for instance by glueing.

When installing a skylight delivered with the flashing frame according to the invention the U-profiles attached to the top and side members of the main frame structure will provide a continuous channel around the window frame structure. Above the top member this channel functions as a valley for water drainage, while the channels along the main frame side members function as drains removing the water, which via the plastically deformable adjoining element below the main frame bottom member is led out across the roof section below the window.

As a consequence of the elastic deformability of the detached side flanges 9, the side members of the main frame structure will be placed in close abutment with the underside of the surrounding roofing and provide an effective screen against water penetration. At the top and side members of the main frame structure the detached side flange 9 provides a satisfactory screen against drifting snow.

The fit to the surrounding roofing is provided mainly by bending the side flange 9 outwards, possibly to such a degree that it is nearly flush with the bottom face 6, which particularly will be the case with plane or flat roofings. With roofings made of roof tiles or similar wave-shaped materials, which are laid upon laths, a more or less upright form of the flange can be retained. FIG. 11 shows the side flange 9 in engagement with the underside of a roofing R made of a wave-shaped material.

In the shown embodiment the window frame structure, as is clearly seen in FIG. 2, is covered by a skirt 13, consisting of profile elements of metal or hard plastic. In connection thereto the flashing frame according to the invention can contribute to an improved seal, in that the side flange 8 attached to the side member 1 of the window frame at its upper section either can be designed with a sealing lip 14 in abutment with an overlying part of the window, for instance the window frame of an openable window, or, as shown in FIG. 2, the glass section itself of a fixed window. The sealing lip 14 can be connected to the side flange 8 by a cover flange 15, which provides good protection of the outside of the frame member 1.

At the uppermost part of the side flange 8 an outwardly protruding sealing flange may be designed for sealing abutment with the inside of the skirt 13.

In an advantageous manner the flashing frame according to the invention offers the possibility of providing an effective sealing flashing in connection with closely spaced neighboring windows on a roof plane, for instance in the case of windows lying side by side, where the mutually opposing sides of the window frame are fastened to the same rafter, such that the space between these frame sides becomes less than the width of the rafter.

For this use the shape of the profile for the flashing elements intended for attachment to the side members of the window frame can be modified as shown in FIG. 3, where a downwardly bent coupling flange 18 is constructed at the bottom section of the side of the side flange 17 facing the inside of the U-profile, and an upwardly protruding rib or bead 21 is constructed on the top side of the bottom face 19 of the profile at a relatively short distance from the other side flange 20. With two closely spaced windows placed side by side the profile elements are cut off along the lines 22 and 23 as shown in FIG. 3, such that the part of the profile in FIG. 3, which lies to the left of the dashed line 22 and contains the coupling flange 18, is attached to one of the mutually opposing side members of the main frame, while the part of the profile in FIG. 3 lying to the left of the dashed line 23 is attached to the other side member, and in addition to the coupling flange 18 contains the rib or bead 21.

The thus mounted profiled flashing elements can then be joined together by allowing the rib or bead 21 of one of the profiles to be positioned under the coupling flange 18 of the other profile, thereby engaging said under coupling flange 18.

For the complete flashing frame with the profile shape in FIG. 3 it is a requirement that the bottom face of the flashing element abutting the top member of the window frame is level with the upper side of the coupling flanges 18 of the two side profiles.

Similarly, the invention provides an opportunity for effective flashing between two windows relatively closely positioned above each other by bending down the detached upright flange 9 of the element attached to the main frame top member of the lower window, after which said detached upright flange 9 is bent down and over-lapped with the plastically deformable adjoining element 12 below the bottom member of the window frame of the above window.

The plastically deformable adjoining element 12, which serves as a shape-fitted connection to the top side of the material underlying the roofing, may consist of a conventional flashing plate containing lead or an unleaded flashing of the type described in aforementioned patent application No. PCT/DK92/0028.

In FIGS. 4–7 a preferred embodiment for the flashing arrangement according to the invention is shown.

The flashing elements 24 and 25 for attachment to the top member and two side members of the window frame structure, respectively, have, as in the embodiments shown in FIGS. 1–3, a mainly U-shaped cross-sectional profile with a bottom face 27, 28, respectively, and a first and second side flange, 29,30 and 31,32, respectively, protruding upwards from the inner and outer edges of the bottom face 27,28.

The first side flange 29, 30 is designed for attachment to the outside of the corresponding side member 33 or top member 34 of the main frame, and in the same manner as shown in FIG. 2 this side flange 29 may at the flashing elements 25 belonging to the side members of the window frame, see FIG. 5, be designed with an outwardly protruding packing flange 35 for a sealing abutment with the inside of a skirt 36 covering the top side and the top part of the outside of the main frame side member 33.

The top part of the first side flange 30 is at the flashing element 24 belonging to the main frame top member 34 in a similar manner covered by a covering rail 37, which extends across the top side of the main frame top member.

As in the embodiments of FIGS. 2 and 3 the detached second side flange 31,32 protrudes upwards from the bottom face 27,28 near the outer edge of said bottom face for the purpose of producing a sealing abutment with the underside of the surrounding roofing. For this purpose the outermost part of the second side flange 31,32 is constructed with a decreasing thickness, such that it provides a kind of sealing lip with good elastic deformability.

While the width of the flashing elements 25 at the side members of the window frame normally should be chosen such that it fits normal rafter widths, for instance 10–12 cm, the detached side flange 31 is placed at such a distance from the first side flange 29 that the flashing element during packing and shipping by utilizing the elasticity of the material can be wrapped up around the window structure with the detached side flange 31 lying over the top side of the structure. The relatively small part of the edge section of the flashing element, which lies outside the detached side flange 31, can in this situation provide a certain additional protection of the frame structure of the window against mechanical damage.

As apparent in FIG. 6 the flashing element 24 at the main frame top member 34 is designed with an increased width compared to the flashing elements 25 at the main frame side members for the purpose of providing a valley as explained previously.

The mainly L-shaped flashing element 26 at the main frame bottom member 40 is in this embodiment, as shown in FIG. 7, constructed with a catching flange 41 extending diagonally backwards and downwards on the bottom side at or near its free outer edge. The catching flange 41 encloses the edge of a spring rail 42, which is attached to the main frame bottom member 40 behind the attachment flange 43 of the flashing element 26 and is downwardly preloaded, such that the spring rail 42 during the utilization of the flashing arrangement in connection with a plane roofing, as for instance slating or cardboard, pulls the outer edge, likewise constructed as a sealing lip, into sealing abutment with the top side of the roofing.

In FIGS. 8 and 9 it is illustrated how the embodiment of the flashing arrangement shown in FIGS. 4–7 is employed in connection with the building together of two relatively closely spaced windows positioned either above or next to each other.

To enable the coupling of two flashing elements along the mutually opposing side members of the window frame in the case of windows positioned side by side, a coupling flange 44 is constructed at the flashing element 25, said coupling flange 44 being positioned on the top side 27 of the bottom face of the U-profile at a relatively short distance from the attachment flange 29 while extending substantially in parallel to the bottom face 27 and towards the attachment flange 29.

During the installation of two juxtaposed windows, the part of the flashing element lying between the coupling flange 44 and the detached flange 31 is cut off from each of the flashing elements 25 on the mutually opposing side members 33 of the frame, i.e. along the dashed line 45 in FIG. 4.

The coupling flanges are then connected by means of a sliding profiled rail 46 with flange sections that are bent around, gripping into the spaces between the two coupling flanges 44 and the bottom faces 27 of the flashing element 25.

For use in connection with coupling to the bottom flashing element 26 of a window positioned above, the flashing element 24 at the main frame top member 34 is designed with an additional upwardly protruding flange 47, as shown in FIG. 6, in the middle area between the attachment flange 30 and the detached flange 32.

During installation the part lying outside the additional flange 47 is cut off from the flashing element 24, i.e. along the dashed line 48 in FIGS. 4 and 6, and the flashing element connected to the top member of the frame 34 can now be placed under the flashing element 26 connected to the bottom member of the frame of the above window, the additional flange 47 being in abutment with the main frame bottom member of the above window.

The flashing arrangement in FIGS. 4–7 can be manufactured in the same manner as described in the above, i.e. by welding together appropriate lengths of extruded profile elements with the shown and described cross-sectional profiles in such a manner that the welded frame, as shown in FIG. 4, provides an open channel around the window frame structure, or the arrangement can be produced as an assembled unit by injection moulding.

As already explained, the flashing arrangement is mounted on the main frame structure in the factory, and the complete window including the mounted flashing elements is delivered in an embodiment completely ready for installation, whereby the work of providing separate flashings of conventional materials is avoided.

To improve the fit to a wave-shaped roofing an additional element 49 may be delivered with the flashing arrangement, as shown in FIG. 10. This element has a substantially U-shaped unfolded configuration, such that it comprises two relatively short side pieces 50 and 51, which after removal of the detached flanges 31 at the bottom part of the flashing elements 25 connected to the main frame side members may be placed under the bottom part of these flashing elements and the flashing element 26 connected to the main frame bottom member, which also in this case is pressed downwards when installing a spring rail, as shown in FIG. 7. As described previously, a flexible and plastically deformable adjoining element 52 of a known type is connected to the bottom edge of the additional element 49.

What is claimed is:

1. A flashing arrangement for a roof window, with a mainly rectangular window frame comprising a top member (34), two side members (1,33), and a bottom member (40), the flashing arrangement comprising flashing elements (2–5, 24–26) for attachment to said window frame members, said flashing elements being profiles of a flexible material for providing a waterproof flashing frame around the window frame, the flashing elements (2,3,4; 24,25) at the top and side members of the window each having a U-shaped cross section comprising a bottom plane (6; 27–28), which in its working position is substantially parallel to the glass section of the window (7), and two upwardly protruding side flanges (8,9; 29,31; 30,32), of which a first side flange (8,29,30) is attached to the outside of the corresponding member (1; 33,34) of the window frame characterized in that the flashing arrangement is a single, integral rectangular flashing frame, with said bottom plane and said flanges of all flashing elements of the single, integral rectangular flashing frame being made from the same flexible material and comprising in addition to said flashing elements (2,3,4; 24,25) at the top and side members of the window frame a bottom flashing element (5,26) for attachment to said bottom member (40), said bottom flashing element having a mainly L-shaped cross section being made of an elastically deformable material, the other of said two side flanges (9,31,32) of said U-shaped flashing elements (2,3,4;24,25) serving as a seal in sealing abutment with the underside of a roofing surrounding the window, while said L-shaped bottom flashing element (5,26) includes an upright flange (43) for connection to the outside of said bottom member (40) and an outwardly protruding flange.

2. A flashing arrangement according to claim 1, characterized in that the first side flange (8) at its top side is designed with a sealing lip (14) for abutment with the underside of the overlying part (7) of the window.

3. A flashing arrangement according to claim 2, characterized in that said sealing lip (14) by means of a covering flange lying on the top side of the frame member (1) is connected to the first side flange (8).

4. A flashing arrangement according to claim 1, characterized in that an outwardly protruding sealing flange (16, 35) is designed at the upper part of the first side flange (8, 25) for abutment with the inside of an outer protective element (13, 36) attached to the window frame member (1).

5. A flashing arrangement according to claim 1, characterized in that a downwardly bent coupling flange (18) is constructed at the bottom part of a side of one of the side flanges (17) facing the inside of the flashing element, and an upwardly protruding rib or bead (21) is provided on the top side of the bottom face (19) at a relatively short distance from the other of the side flanges (20), such that when the flashing elements of two mutually opposing frame members of closely spaced neighboring windows are to be connected, the said rib or bead may be placed under said coupling flange after cutting off parts of the flashing elements attached to the frame members, thereby engaging under said coupling flange (18).

6. A flashing arrangement according to claim 1, characterized in that a coupling flange (44) is constructed on the top side of the bottom face (27) of the flashing element at a relatively short distance from said first side flange (29), said coupling flange extending towards said first side flange substantially in parallel to the bottom face, such that said coupling flange during the installation of the window and a neighboring window side by side may be placed in abutment with a corresponding coupling flange (44) of the neighboring window after the part of the flashing elements of both windows lying on a side of said coupling flange (44) distal to its respective window along the mutually opposing side members of the window frame is cut off, after which the two coupling flanges (44) are connected by a sliding profiled rail (46) with bent flange sections fitting into the space between the two coupling flanges (44) and the bottom faces (27) of the respective flashing elements (25).

7. A flashing arrangement according to claim 1, characterized in that the flashing element (24) at the top member (34) is designed with an increased width compared to the flashing elements (25) at the window frame side members.

8. A flashing arrangement according to claim 7, characterized in that the flashing element (24) of the top member in the middle area between said first and second side flanges (30, 32) has an additional upwardly protruding flange (47), which during the installation of two windows above each other may be placed under the L-shaped bottom flashing element (26) at the bottom member (40) of the frame of the above window after having cut off the part of the flashing element lying between said additional flange (47) and the other side flange (32).

9. A flashing arrangement according to claim 1, for use in connection with flat and plane roofings, characterized in that the mainly L-shaped bottom flashing element (26) at the bottom member (40) of the window frame at or near its free outer edge on its bottom side has a catching flange (41) extending diagonally backwards, where the said catching flange is designed to enclose a spring rail (42) attached to the bottom member (40) of the window frame while in contact with the bottom side of the flashing element (26), said spring rail (42) being attached in a direction towards the underlying roofing in order to keep the bottom flashing element (26) in sealing abutment with the top side of said roofing.

10. A flashing arrangement according to claim 1 for use in connection with wave-shaped roofings, characterized in that the flashing arrangement comprises an additional element (49) with a U-shaped unfolded configuration underlying and connected with said L-shaped bottom flashing element (11), said additional element (49) including two relatively short side pieces (50, 51) positioned under the lower parts of the flashing elements (25) at the window frame side members (33) and where said additional element (49) at the outer edge thereof is connected to an adjoining element (52), said adjoining element being flexible and plastically deformable.

11. A flashing arrangement according to claim 1, characterized in that the flashing elements (2–4; 24–26) are made of rubber.

12. A flashing arrangement according to claim 1, characterized in that the flashing elements (2–4; 24–26) are made of a thermoplastic elastomer.

13. A flashing arrangement according to claim 11, characterized in that the flashing elements (2–4; 24–26) are manufactured as extruded profiles, which can be joined by welding in order to produce a flashing frame.

14. A flashing arrangement according to claim 12, characterized in that the flashing arrangement is manufactured as a flashing frame in one piece by compression or injection moulding.

15. A flashing arrangement according to claim 1, wherein each of the flashing elements at the top and side members of the window is made of one piece.

16. A roof window comprising:

a mainly rectangular window frame having a top member, two side members, and a bottom member; and a flashing arrangement including flashing elements attached to said window frame members, said flashing elements being profiles of a flexible material providing a waterproof flashing frame around the window frame, the flashing elements at the top and side members of the window each having a U-shaped cross section comprising a bottom plane, which in its working position is substantially parallel to the glass section of the window, and two upwardly protruding side flanges, of which a first side flange is attached to the outside of the corresponding member of the window frame, characterized in that the flashing arrangement is a single, integral rectangular flashing frame, with said bottom plane and said flanges of all flashing elements of the single, integral rectangular flashing frame being made from the same flexible material and comprising in addition to said flashing elements at the top and side members of the window frame a flashing element for attachment to said bottom member, said bottom flashing element having a mainly L-shaped cross section being made of an elastically deformable material, the other of said two side flanges of said U-shaped flashing elements serving as a seal in sealing abutment with the underside of a roofing surrounding the window, while said L-shaped bottom flashing element includes an upright flange for connection to the outside of said bottom member and an outwardly protruding flange.

17. A roof window according to claim 16, characterized in that the first side flange (8) at its top side is designed with a sealing lip (14) for abutment with the underside of the overlying part (7) of the window.

18. A roof window according to claim 17, characterized in that said sealing lip (14) by means of a covering flange (15) lying on the top side of the frame member (1) is connected to the first side flange (8).

19. A roof window according to claim 16, characterized in that an outwardly protruding sealing flange (16, 35) is designed at the upper part of the first side flange (8,25) for abutment with the inside of an outer protective element (13, 36) attached to the window frame member (1).

20. A roof window according to claim 16, characterized in that a downwardly bent coupling flange (18) is constructed at the bottom part of a side of one of the side flanges (17) facing the inside of the flashing element, and an upwardly protruding rib or bead (21) is provided on the top side of the bottom face (19) at a relatively short distance from the other of the side flanges (20), such that when the flashing elements of two mutually opposing frame members of closely spaced neighboring windows are to be connected, the said rib or bead may be placed under said coupling flange after cutting off parts of the flashing elements attached to the frame members, thereby engaging under said coupling flange (18).

21. A roof window according to claim 16, characterized in that a coupling flange (44) is constructed on the top side of the bottom face (27) of the flashing element at a relatively short distance from said first side flange (29), said coupling flange extending towards said first side flange substantially in parallel to the bottom face, such that said coupling flange during the installation of the window and a neighboring window side by side may be placed in abutment with a corresponding coupling flange (44) of the neighboring window after the part of the flashing elements of both windows lying on a side of said coupling flange (44) distal to its respective window along the mutually opposing side members of the window frame is cut off, after which the two coupling flanges (44) are connected by a sliding profiled rail (46) with bent flange sections fitting into the space between the two coupling flanges (44) and the bottom faces (37) of the respective flashing elements (25).

22. A roof window according to claim 16, characterized in that the flashing element (24) at the top member (34) is designed with an increased width compared to the flashing elements (25) at the window frame side members.

23. A roof window arrangement according to claim 22, characterized in that the flashing elements (24) of the top member in the middle area between said first and second side flanges (30, 32) has an additional upwardly protruding flange (47), which during the installation of two windows above each other may be placed under the L-shaped bottom flashing element (26) at the bottom member (40) of the frame of the above window after having cut off the part of the flashing element lying between said additional flange (47) and the other side flange (32).

24. A roof window according to claim 16, for use in connection with flat and plane roofings, characterized in that the mainly L-shaped bottom flashing element (26) at the bottom member (40) of the window frame at or near its free outer edge on its bottom side has a catching flange (41) extending diagonally backwards, wherein the said catching flange is designed to enclose a spring rail (42) attached to the bottom member (40) of the window frame while in contact with the bottom side of the bottom flashing element (26), said spring rail (42) being attached in a direction towards the underlying roofing in order to keep the flashing element (26) in sealing abutment with the top side of said roofing.

25. A roof window according to claim 16 for use in connection with wave-shaped roofings, characterized in that the flashing arrangement comprises an additional element (49) with a U-shaped unfolded configuration underlying and connected with said L-shaped bottom flashing element (11), said additional element (49) including two relatively short side pieces (50,51) positioned under the lower parts of the flashing elements (25) at the window frame side members (33), and where said additional element (49) at the outer edge thereof is connected to an adjoining element (52), said adjoining element being flexible and plastically deformable.

26. A roof window according to claim 16, characterized in that the flashing elements (2–4; 24–26) are made of rubber.

27. A roof window according to claim 16, characterized in that the flashing elements (2–4; 24–26) are made of a thermoplastic elastomer.

28. A roof window according to claim 26, characterized in that the flashing elements (2–4; 24–26) are manufactured as extruded profiles, which can be joined by welding in order to produce a flashing frame.

29. A roof window according to claim 27, characterized in that the flashing arrangement is manufactured as a flashing frame in one piece by compression or injection moulding.

30. A roof window according to claim 16, wherein each of the flashing elements at the top and side members of the window is made of one piece.

* * * * *